United States Patent [19]

Laske

[11] 3,980,260

[45]*Sept. 14, 1976

[54] INFLATABLE KITE

[75] Inventor: Louis Lawrence Laske, Grayslake, Ill.

[73] Assignee: Vonco Products, Inc., Lake Villa, Ill.

[ * ] Notice: The portion of the term of this patent subsequent to Apr. 2, 1988, has been disclaimed.

[22] Filed: Sept. 26, 1974

[21] Appl. No.: 509,491

Related U.S. Application Data

[63] Continuation of Ser. No. 347,879, April 4, 1973, abandoned.

[52] U.S. Cl. ..... 244/153 R; D34/15 AF

[51] Int. Cl.[2] ..... B64C 31/06

[58] Field of Search ..... 244/153 R, 154, 33; D34/15 AF; 46/89

[56] References Cited

UNITED STATES PATENTS

| | | | |
|---|---|---|---|
| 3,093,354 | 6/1963 | Pohl | 244/154 |
| 3,198,458 | 8/1965 | Fink | 244/DIG. 1 |
| 3,335,985 | 8/1967 | Neal | 244/153 R |
| D223,716 | 5/1972 | Choong | D34/15 AF |
| D226,389 | 2/1973 | Madonia | D34/15 AF |
| D231,114 | 4/1974 | Laske | D34/15 AF |
| D231,245 | 4/1974 | Christoffel | D34/15 AF |
| D232,961 | 9/1974 | Laske | D34/15 AF |

FOREIGN PATENTS OR APPLICATIONS

| | | | |
|---|---|---|---|
| 1,408,652 | 7/1965 | France | 244/153 R |
| 614,064 | 12/1960 | Italy | 244/153 R |

*Primary Examiner*—Trygve M. Blix
*Assistant Examiner*—Galen L. Barefoot
*Attorney, Agent, or Firm*—Thomas W. Speckman

[57] ABSTRACT

An inflatable kite exhibiting excellent lift and stability characteristics without an auxiliary tail and comprising an inflatable body member provided with a rounded leading edge and having a substantially teardrop shape, two inflatable opposing rearwardly projecting side members attached to said body member and together forming a single inflated volume, a web of flexible sheet material connected between each side member and said body member and extending over at least about 50% of the area defined by said body member, the side member and a straight line joining the rear extremities of said body member and said side member, and a line attachment member bonded to said body member; the ratio of the maximum width to the length of the inflated kite being about 0.5 to 1.5.

12 Claims, 7 Drawing Figures

INFLATABLE KITE

This is a continuation of application Ser. No. 347,879, filed Apr. 4, 1973, now abandoned.

This invention relates to inflatable kites having improved lift and stability characteristics.

The kite of this invention exhibits excellent flight characteristics in mild breezes as well as in high winds without the requirement of an auxiliary tail. The kite of this invention affords several advantages as a toy or recreational device since it has excellent lift and stability, rendering it an easy and satisfying kite for children. Further, the kite of this invention, when deflated, may be folded or rolled into a compact package and requires only inflation and the attachment of string to ready it for flight. As compared with conventional paper and box kites having sticks or other breakable structures, the kites of this invention are only subject to punctures which can be readily repaired.

Many of the kites known prior to this invention do not perform satisfactorily when produced in small sizes necessary when used as premiums. The kite of this invention has been found to perform well in a wide variety of sizes making it an excellent flyer in a small size necessary as a premium with the purchase of another item as well as in a large size so that the kite may serve advantageously in emergency situations such as raising an antenna for emergency radio, serving as a radar reflector, and the like.

The advantages of this invention will become more apparent in the drawings in which the kite is shown inflated wherein.

Figure 1:
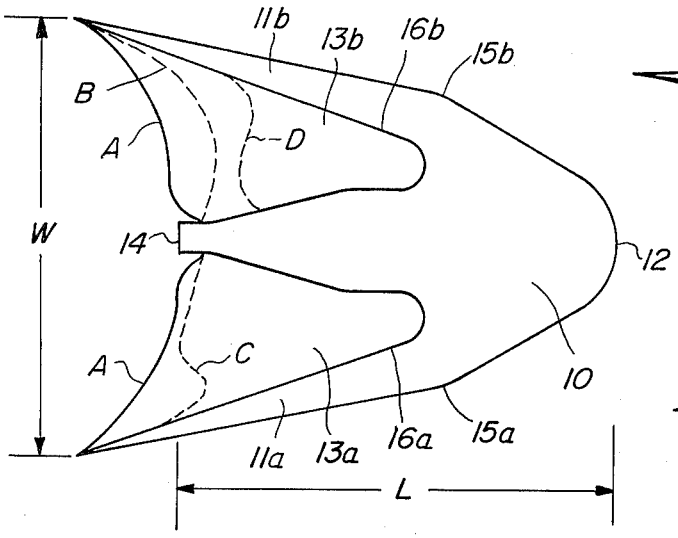
FIG. 1 is a top view of a kite of one preferred embodiment of this invention.

Referring to FIG. 1, a kite of this invention may be generally described as having an inflatable hollow body member 10 with a rounded leading edge and having substantially teardrop shape. Two opposing rearwardly projecting side members 11*a* and 11*b* are attached to the body member and together form a single inflatable volume. The substantially teardrop shape may be best seen in FIG. 3, a side elevational view of the kite of FIG. 1. Body member 10 and rearwardly projecting side members 11*a* and 11*b* may be inflated with air, or any lifting gas, through a single opening provided by vent means 14. Webs 13*a* and 13*b* connect each of the side members 11*a* and 11*b*, respectively, to body member 10. Webs 13*a* and 13*b* are not inflated, but are flexible sheets.

Figure 6:
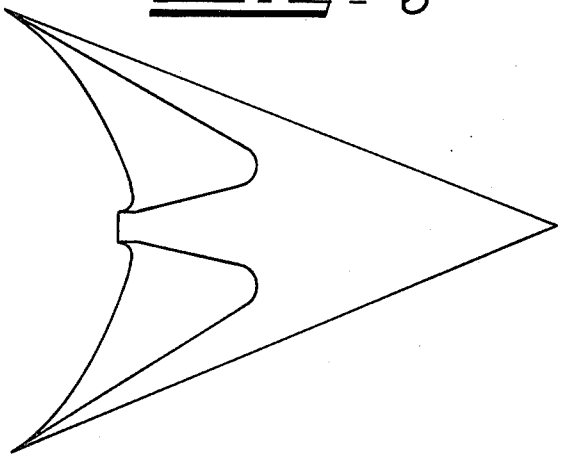
FIG. 6 is a top view of another kite shown for comparative purposes.

I have found that to achieve the objects of excellent lift and stability for kites of this invention, the kite must have a generally rounded nose portion shown in FIG. 1 as 12. The rounded nose portion may be smoothly aligned with the outer edges of the projecting side members 11*a* and 11*b* or may be discontinuous by having shoulders as shown in FIG. 1 as 15*a* and 15*b*. More pronounced shoulders, shown in FIG. 4 as 15*c* and 15*d*, are also satisfactory for kites of this invention. However, I have found that the rounded nose is desired for the kite of this invention, giving better stability without a tail. By comparison with a kite of this invention as exemplified by FIGS. 1 through 4, the kite shown in FIG. 6, having a pointed nose and otherwise being of the same size and the same proportions as the kite shown in FIG. 1, showed considerable loss of stability and some loss of lift.

Figure 5:
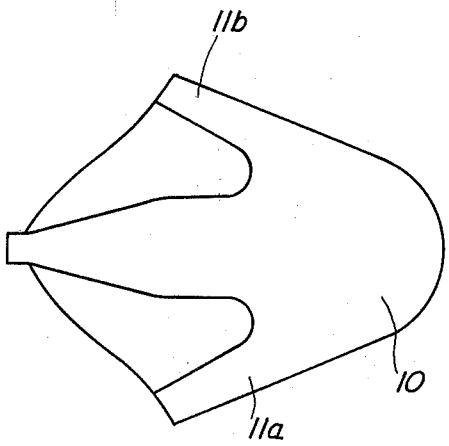
FIG. 5 is a top view of a kite shown for comparative purposes.

I have also found that to achieve the objects of this invention, it is desirable that the two rearwardly projecting side members 11*a* and 11*b* extend rearwardly about as far as body member 10 and preferably further. The side members may be straight cylindrical or rearwardly tapered in shape. The side members may be curved either outwardly or inwardly. It is preferred that the side members extend rearwardly beyond the body and be tapered to a point at their extremities. The kite shown in FIG. 5 for comparison, is of the same size and has the same proportions as FIG. 1 except the rearwardly projecting side members 11*a* and 11*b* and a corresponding portion of the webs 13*a* and 13*b* were removed, making the side members shorter than body member 10. The kite shown in FIG. 5 for comparison, lost considerable lift and was not a satisfactory flying kite as a result of great loss of stability as compared with the kite shown in FIG. 1.

Figure 7:
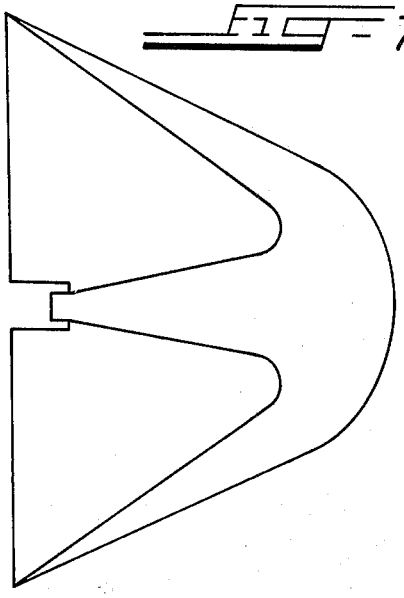
FIG. 7 is a top view of a kite shown for comparative purposes.

I have also found that the ratio of overall width to length of the kite is important to obtain superior lift and stability of the kite of this invention. I have found that the ratio of overall width to length (W/L) must be about 0.5 to 1.5. Preferably, W/L is about 0.9 to 1.3. FIG. 7 for comparison, shows a kite of general similarity to the kite of FIG. 1 except the W/L ratio is about 2. The kite shown in FIG. 7 had insufficient lift and stability to fly in a moderate breeze. All of the above relationships refer to the inflated kite.

The trailing edge of webs 13*a* and 13*b* may have a wide variety of shapes ranging from the shape shown in FIG. 1 as solid lines and identified as A, extending from the outer extremity of side members 11*a* and 11*b* to the trailing edge of body member 10, to the minimum web size to obtain good flying characteristics which is approximated by dotted line D. Between the boundaries of A and D, any shape is suitable, and webs 11*a* and 11*b* may be scalloped or of any other shape as exemplified by dotted lines B and C. It has been found that to obtain the superior lift and stability characteristics of a kite of this invention, a web of flexible sheet material connected between each side member and body member and extending over at least about 50% of the area defined by the body member, the side member and a straight line connecting the rear extremities of the body member and side member is desirable. The webs may extend rearwardly of the rear extremity of the body and provide trailing edges for the kite. Webs 13*a* and 13*b* may be taut as shown by dotted lines E in FIG. 2 or, preferably, have some sag as shown by solid lines F in FIG. 2. The degree of sag is governed by the extent of shoulders 15*a* and 15*b*.

It is desired that webs 13*a* and 13*b* be of flexible material and not inflated. For comparison, a kite of the same size and proportions as the kite shown in FIG. 1 was fabricated wherein seals 16*a* and 16*b* were maintained except for an interior passage to body member 10, permitting webs 13*a* and 13*b* to be inflated. The inflation of webs 13*a* and 13*b* was found to considerably decrease the lift characteristics of the kite and also to reduce the stability characteristics.

To further show the desirability of webs 13*a* and 13*b* being uninflated, a kite of the same size and proportions as the kite shown in FIG. 1 was fabricated omitting seals 16*a* and 16*b* so that webs 13*a* and 13*b*, body member 10 and projecting side members 11*a* and 11*b*, were inflated into a single chamber of teardrop shape. The kite so constructed was not flyable, having lost essentially all of its lift and having poor stability.

Still further, a kite was fabricated of the same size and proportions as the kite shown in FIG. 1, except that an inflated tube was extended across the trailing edge A of webs 13*a* and 13*b*. The inflated tube was of the general nature shown in U.S. Pat. No. 2,733,880. Such a kite did not achieve the objects of this invention as it showed greatly reduced lift, requiring strong kite-flying winds to fly.

Figure 3:
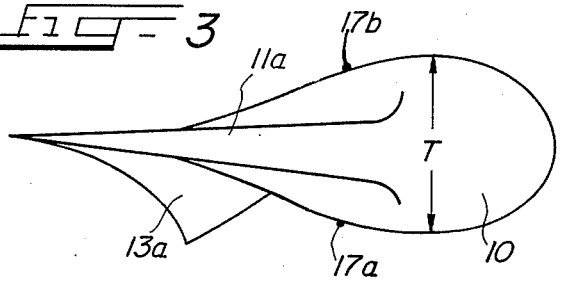
FIG. 3 is a side elevational view of the kite shown in FIG. 1.
Figure 2:
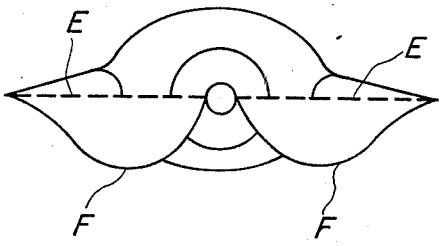
FIG. 2 is a rear elevational view of the kite shown in FIG. 1.

The kite as shown in FIGS. 1, 2 and 3, is preferably flown from a single line secured to attachment means shown in FIG. 3 as 17*a*. The kite may be flown with multiple points of attachment or multiple lines which merely reduce the requirement for high lift and stability requirements of the kite itself. The attachment means 17*a* may be any suitable plastic or cloth material bonded to the kite and having suitable means for attachment of string, monofilament lines, or the like. Attachment means 17*a* is located aft of the area of maximum thickness of the teardrop shape of body member 10 of the kite, i.e., aft of the thickest portion of body member 10. Since the kite of this invention is symmetrical, a second attachment means 17*b* may be attached at a corresponding location on the top side of the kite to permit the kite to be flown with either side up.

To obtain the most advantageous lift characteristics, the maximum thickness of the inflated body, shown as T in FIG. 3, should be about 0.15 to 0.45 L, as shown in FIG. 1. Preferably, T is about 0.30 L.

Vent means 14 may be placed at any suitable location so that when air or a lifting gas is blown inwardly, the body member 10 and side members 11*a* and 11*b* in communication with body member 10, are inflated. After inflation, vent means 14 may be twisted and/or folded upon itself and tied or fastened by a rubber band. Vent means 14 may also be in the form of any suitable one-way valve or self-sealing aperture.

I have found contrary to the teachings of U.S. Pat. No. 3,003,722, which teaches a plurality of interconnected hollow inflated chambers in an inflatable kite, that a single, generally rigid inflated body and rearwardly projecting side members are desirable to obtain the superior performance of the kite of this invention.

I have found contrary to the teachings of U.S. Pat. No. 3,335,985 which teaches attachment of a single string at the maximum thickness of an inflated kite, that the kite of this invention preferably has string attachment means 17*a* located aft of the maximum thickness region. When the string attachment means is located as shown in FIG. 3, the kite of this invention flies at an angle of about 45° to 80° from horizontal, depending on wind conditions, exhibiting constant lift and excellent stability.

From the above comparative kites, it is seen that in order to achieve the benefits of the kite of this invention, the nose is rounded, the relation W over L is 0.5 to 1.5, the rearwardly projecting side members are about as long as the body and preferably longer, and the side members are joined to the body portion with an uninflated web occupying at least 50% of the area between the rearwardly projecting side members 11*a* and 11*b* and body member 10.

Figure 4:
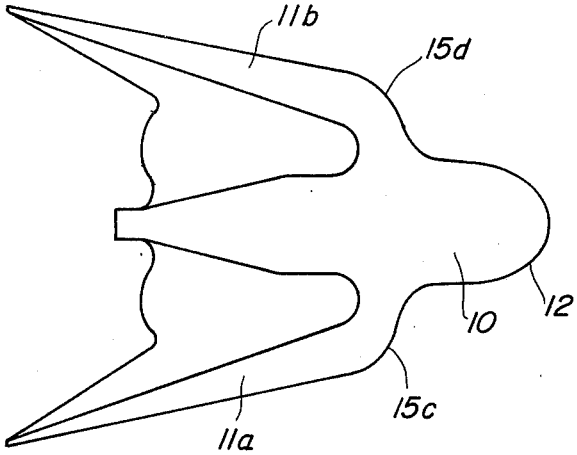
FIG. 4 is a top view of a kite showing another preferred embodiment of this invention.

The kite of this invention may be economically fabricated, preferably from two sheets of a thin thermoplastic material, such as polyethylene, having the same configuration and sealing the entire periphery of the two sheets, one to the other, except for inflation opening 14; and sealing the two sheets at seals 16*a* and 16*b*, all such seals being air tight to form the single chamber inflated shape such as shown in FIGS. 1 and 4. Any gas impervious sheet material may be used.

The kite of this invention has been found to perform well without any auxiliary tail in mild breezes as well as high winds. If desired, however, the kite of this invention may be flown with a tail of single or multiple ribbons attached at the rear portion of the body.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A kite comprising:

an inflatable rearwardly tapering body member provided with a rounded leading edge which when said body is inflated is rounded in both plan and side views forming the leading edge of said kite and having substantially smooth teardrop shape, two inflatable opposing rearwardly projecting side members extending when inflated rearwardly to at least about the rear extremity of said body member attached to said body member and together forming a single inflated volume wherein said rounded leading edge is connecting with the outer edges of said side members;

a non-inflatable web of flexible sheet material connected between the trailing edge of each rearwardly projecting side member and said body member, said web extending over at least 50% of the area defined by said body member the side members and straight lines joining the rear extremities of said body member and each of said side members;

a line attachment means bonded to said body member; and the ratio of the maximum width of the kite when inflated to the length of the kite being 0.5 to 1.5.

2. The kite of claim 1 wherein said rearwardly projecting side members extend beyond the rear of said body member.

3. The kite of claim 1 wherein said rearwardly projecting side members are tapered toward their extremities.

4. The kite of claim 1 wherein said web is taut.

5. The kite of claim 1 wherein said web has sag.

6. The kite of claim 1 wherein said line attachment means is a single attachment means bonded to said body member aft of the thickest portion of said body member.

7. The kite of claim 1 having a vent means at the rear of said body member.

8. The kite of claim 1 wherein said ratio of width to length is 0.9 to 1.3.

9. The kite of claim 1 wherein the maximum thickness of said inflatable body when inflated is 0.15 to 0.45 of said length.

10. The kite of claim 1 wherein said non-inflatable web extends rearwardly of the rear extremity of said body member and forms a trailing edge.

11. The kite of claim 1 wherein said rounded leading edge is smoothly aligned with and connecting with the outer edges of said side members.

12. The kite of claim 1 wherein said rounded leading edge is discontinuous with the outer edges of said side members forming shoulders at the connection of said rounded leading edge with the outer edges of said side members.

* * * * *